United States Patent [19]

Jones

[11] Patent Number: 4,993,883

[45] Date of Patent: Feb. 19, 1991

[54] PNEUMATIC UNLOADING APPARATUS FOR BULK MATERIALS

[75] Inventor: Robert F. Jones, Winston-Salem, N.C.

[73] Assignee: Nabisco Brands, Inc., East Hanover, N.J.

[21] Appl. No.: 465,300

[22] Filed: Jan. 16, 1990

[51] Int. Cl.[5] ..... B60P 1/60

[52] U.S. Cl. ..... 406/39; 406/118; 406/145

[58] Field of Search ..... 406/38, 39, 43, 44, 406/108, 117, 118, 119, 127, 145; 414/141.8, 142.2, 291, 467, 507; 105/247

[56] References Cited

U.S. PATENT DOCUMENTS

| | | | |
|---|---|---|---|
| Re. 24,926 | 12/1960 | Oliver . | |
| 2,629,637 | 2/1953 | Hornbrook . | |
| 2,693,282 | 11/1954 | Sensibar . | |
| 2,695,196 | 11/1954 | Talmey et al. . | |
| 2,721,006 | 10/1955 | Knutsen | 406/39 |
| 2,746,809 | 5/1956 | Gebhardt . | |
| 3,220,778 | 11/1965 | Aller | 406/118 |
| 3,583,768 | 6/1971 | Koranda | 406/118 |
| 3,675,975 | 7/1972 | Mundinger et al. . | |
| 3,724,909 | 4/1973 | Adler . | |
| 3,734,569 | 5/1973 | Vingas | 406/118 |
| 4,140,349 | 2/1979 | Behnken | 406/39 |
| 4,147,392 | 4/1979 | Fuss | 406/39 |
| 4,884,923 | 12/1989 | Wellink | 406/39 |

*Primary Examiner*—Sherman Basinger
*Assistant Examiner*—Stephen P. Avila
*Attorney, Agent, or Firm*—Scully, Scott, Murphy & Presser

[57] ABSTRACT

An apparatus for unloading bulk materials from hopper-type rail cars and, more particularly, a pneumatic unloading apparatus or device incorporating a dual outlet for the pneumatically-actuated discharging of flowable bulk materials from the bottom of a hopper structure, and in which the bulk material is aspirated from the hopper structure into a pair of parallel conduits through spaced discharge orifices designed to minimize or eliminate any possible damage to the bulk material during the procedure of being conveyed therethrough.

6 Claims, 3 Drawing Sheets

PNEUMATIC UNLOADING APPARATUS FOR BULK MATERIALS

BACKGROUND OF THE INVENTION

1. Field of the Invention

The present invention relates to an apparatus for unloading bulk materials from hopper-type rail cars and, more particularly, relates to a pneumatic unloading apparatus or device incorporating a dual outlet for the pneumatically-actuated discharging of flowable bulk materials from the bottom of a hopper structure, and in which the bulk material is aspirated from the hopper structure into a pair of parallel conduits through spaced discharge orifices designed to minimize or eliminate any possible damage to the bulk material during the procedure of being conveyed therethrough.

In the transport of flowable bulk material through the intermediary of rail cars which contain compartments with hopper bottoms, and in which the bulk materials are generally loaded into the rail cars from inlet parts at the tops thereof, and discharged through hoppers constructed at the bottoms of the rail cars, the bulk materials are frequently subjected to rough handling during the conveyance thereof out of the hoppers. Generally, the hoppers are connected to pneumatic outlets; in essence, an external vacuum which is applied to the outlets in order to assist in the aspiration of the bulk materials being discharged through the bottom hoppers of the rail cars. Although, in many instances, when such flowable bulk materials are constituted of goods which are not easily damaged as a result of rough handling during discharge through the pneumatic outlets of the railway car hoppers, for instance, flour, sugar, cereals, grains, plastics and numerous other kinds of such bulk commodities; nevertheless, under circumstances such rough handling during discharge may damage the bulk materials to an extent so as to possibly render them substantially unfit for their intended use and thereby considerably lower the value of thusly damaged commodities. Thus, for instance, shelled whole peanuts are frequently shipped in bulk quantities in rail cars of the hopper-type, and at their destinations are discharged through orifices in the bottom hoppers by the intermediary of well-known vacuum-pneumatic outlet devices by the application of a vacuum through tubes connected to conduits at the bottom outlets of the hoppers. Usually, the pneumatic outlet device communicates with the bottom of the hopper by a single discharge orifice, and in which hoses or flexible tubes are connected to a pipe or conduit at the bottom of the hopper, and incorporates rotary valve structure for selectively opening and closing the discharge, causing the shelled peanuts to travel through extensive and frequently extremely sharp bends or circuitous flow paths while being aspirated from the hopper at a high velocity under the action of a vacuum. This frequently causes the shelled whole peanuts to be either split into halves, and possibly even broken into smaller parts or fragments, thereby rendering such shelled peanuts unsuitable for use as generally more expensive cocktail peanuts or for applications in which it is desired to dip whole peanuts into chocolate, candy coverings or the like. The splitting or fracturing of the shelled whole peanuts would then necessitate their utilizations in less expensive products, such as peanut butter, peanut brittle or the like which do not require whole peanuts, thereby greatly diminishing their commercial or sales value and producing considerable financial losses to the owner or shipper of the bulk material. Consequently, although in some cases, the essentially rough handling of the flowable bulk materials during discharge from the hopper rail car which is encountered due to the circuitous path to which such materials or commodities are subjected, there is not of any special criticality with regard to any potential commercial loses because of the inherent resistance to damaging by such bulk materials. However, in instances where the commodities are of a generally fragile or easily damaged nature, such as shelled whole peanuts, in the integrity of the material must be maintained to avoid extensive commercial losses, it is desired that abrupt changes in the flow path of the materials being discharged be avoided wherever possible, and that the bulk materials are conveyed in a generally smooth path from the pneumatic outlet apparatus of the rail car hopper under the presence of a vacuum.

In order to be able to attain an improved and inventive discharge for the flowable bulk materials, particularly in instances when the nature of the materials allows them to be easily damaged, such as shelled whole peanuts where it is incumbent to avoid any splitting or fragmenting of the peanuts during discharge from the hopper, the latter is provided with a dual pneumatic outlet consisting of first and second discharge orifices each extending partly across the transverse width of the rail car, the orifices being axially spaced from each other and offset on opposite sides of a longitudinal centerline of the hopper outlet. The discharge orifices communicate the interior of the hopper which consists of a rail car compartment storing a quantity of the bulk material, with a pair of parallel pipes or conduits extending below the respective hopper discharge orifices, with each conduit being connected to respectively one of the discharges so as to, upon appropriate actuation of control valves in the conduits, permit for controlled discharge of the bulk material either simultaneously or selectively through the discharge orifices from the hopper into the parallel extending conduits therebelow. The conduits may be selectively connected at either end thereof to a vacuum-pneumatic outlet for aspirating the materials therethrough from the hopper, thereby ensuring a smooth discharge of the bulk material from the hopper through the discharge orifices, and in view of the linear construction and parallel arrangement of the conduits, avoiding unnecessary bends in the flow path which would possibly lead to damaging of the fragile bulk material.

2. Discussion of the Prior Art

Although numerous hoppers containing hopper outlets of the type considered herein are currently in use, such as vacuum-pneumatic outlet devices employed for the discharging of dry, flowable bulk materials from hopper-type rail cars or similar vehicles, none of these provide for the advantages of having straight, parallel extending conduits positioned below each of the hopper discharge orifices so as to enable the controlled outflow of the bulk material into the conduits in the straightest possible flow bending to ameliorate or possibly even eliminate any undue stress and damage to fragile bulk commodities being rapidly discharged through the vacuum-pneumatic outlet from the hopper.

Talmey, et al. U.S. Pat. No. 2,695,196 discloses a hopper for the storage and transportation of finely divided materials, in which the hopper includes a bottom discharge of a rail car employed for transporting dry, flowable bulk materials, and wherein the rail car is compartmented such that at least two compartments extend transversely of the length of the rail car, in effect, extend across the width of the rail car. Herein, the hopper outlet at the bottom of a downwardly narrowing hopper structure includes a pair of parallel conduits or pipes connected to discharge orifices in the hopper each communicating with a different compartment so as to be able to either concurrently or individually discharge the bulk material from one or both of the compartments in the rail car. Although the construction thereof employs two parallel pipes, the discharge of the flowable bulk material is received by each conduit from a different compartment; whereas, in contrast with the foregoing, pursuant to the present invention, the parallel extending conduits receive the flowable bulk material from a single compartment of the rail car extending across the entire width thereof through the pair of longitudinally spaced discharge orifices arranged at the hopper outlet to straddle an imaginary longitudinal centerline extending across the full width of the rail car. This will enable the present invention to provide for a smoother discharge of a fragile flowable bulk product, such as shelled whole peanuts, into the straight and parallel extending conduits or pipes, and enable the commodity to be aspirated therefrom by the pneumatic outlet apparatus under a vacuum atmosphere with a minimum change in direction of flow for the material Hornbrook U.S. Pat. No. 2,629,637 relates to a pneumatic unloader for use with the bottom hopper of a vehicle, such as a rail car or truck, and in which a pair of openings communicate with adjacent compartments in the vehicle to allow for simultaneous or selective individual discharge of a flowable bulk material. Again, as in Talmey, et al., there is no discharge of the material from a single compartment through a plurality of discharge orifices communicating with a pair of straight, adjacently arranged and parallel extending conduits or pipes communicating with a vacuum-pneumatic outlet device for aspirating the flowable bulk material in a controlled and smoothly flowing manner.

Gebhardt U.S. Pat. No. 2,746,809 pertains to an ash removal unit in which a single hopper includes a pair of discharge ports straddling a centerline of the hopper, and allowing for concurrent or selective discharge of the ash through either one or both of the discharge orifices. However, there are no parallel conduits or piping connected to a pneumatic or vacuum outlet analogous to the present invention which would facilitate the removal of the material, particularly such as relatively fragile shelled whole peanuts, in a manner avoiding undue bends in the direction of discharge flow which enables the present inventive hopper outlet design to protect the integrity of the relatively fragile bulk commodity.

Other types of outlets for hoppers for the controlled removal of dry, flowable bulk materials in the nature of powders, pellets, granules or the like can be ascertained from various patent publications such as Mundinger, et al. U.S. Pat. No. 3,675,975; Oliver U.S. Reissue Pat. No. 24,916 and Adler U.S. Pat. No. 3,724,909.

SUMMARY OF THE INVENTION

However, none of these publications disclose the utilization of a single hopper extending transversely over the full width of a hopper-type rail car adapted to store and transport flowable bulk materials, in which the discharge of the hopper includes a pair of axially-spaced discharge orifices offset on both sides of a longitudinal centerline of the hopper, each respectively communicating with a straight pipe or conduit of a pair of conduits arranged to extend in parallel therebeneath, which enables the conduits to be connected to a vacuum-pneumatic source for aspirating flowable product through one or both of the conduits either simultaneously or selectively from a single compartment storing the bulk material without having to impart any undue deviations to the flow path of a fragile bulk material which would tend to adversely influence the physical properties thereof, thereby resulting in possible damage to the commodity and economic losses to the owner and/or shipper thereof.

Accordingly, it is an object of the present invention to provide a novel dual-discharge hopper and pneumatic outlet construction for a rail car employed in storage and transporting of a flowable bulk material.

Yet another object of the present invention is to provide a pneumatic hopper outlet arrangement of the type described, in which a pair of parallel-extending, straight conduits each communicates with respectively a discharge orifice of the hopper of a single compartment enabling the controlled discharge of the flowable bulk material into the conduits and the smooth-flowing aspiration of the material through the intermediary of a vacuum-pneumatic outlet apparatus.

BRIEF DESCRIPTION OF THE DRAWINGS

Reference may now be had to the following detailed description of an exemplary embodiment of the invention showing the dual-orifice pneumatic hopper outlet construction for a rail car for the controlled discharge of a flowable bulk material; taken in conjunction with the accompanying drawings; in which.

DETAILED DESCRIPTION

Figure 1:
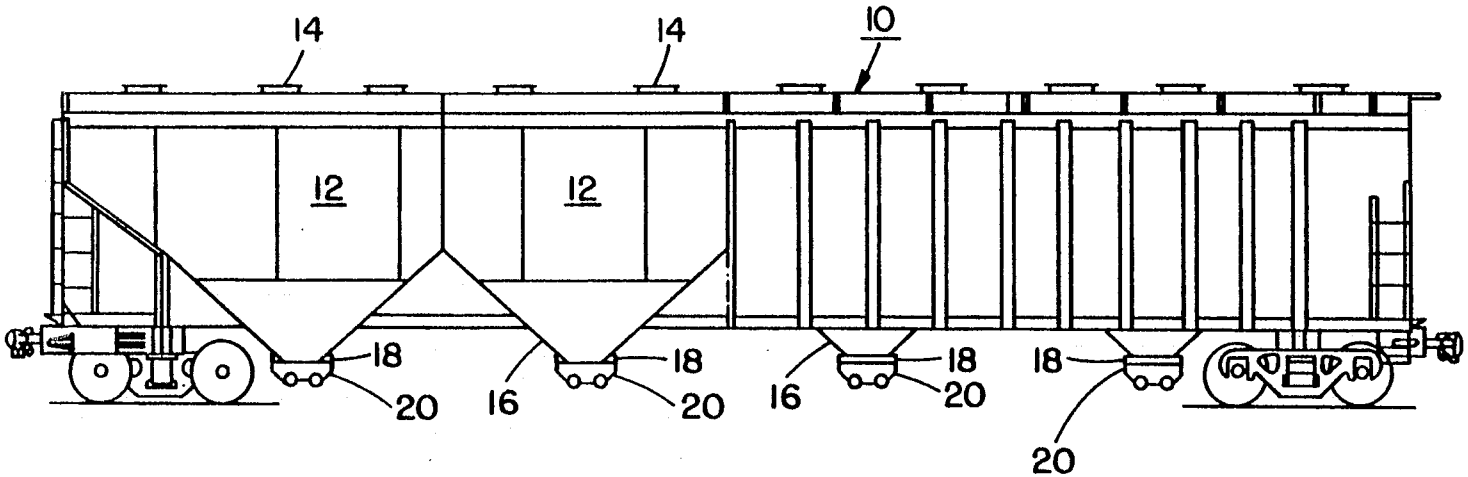
FIG. 1 illustrates a side elevational view of a hopper rail car incorporating inventive pneumatic hopper outlet or unloading apparatus for a flowable bulk material.
Figure 2:
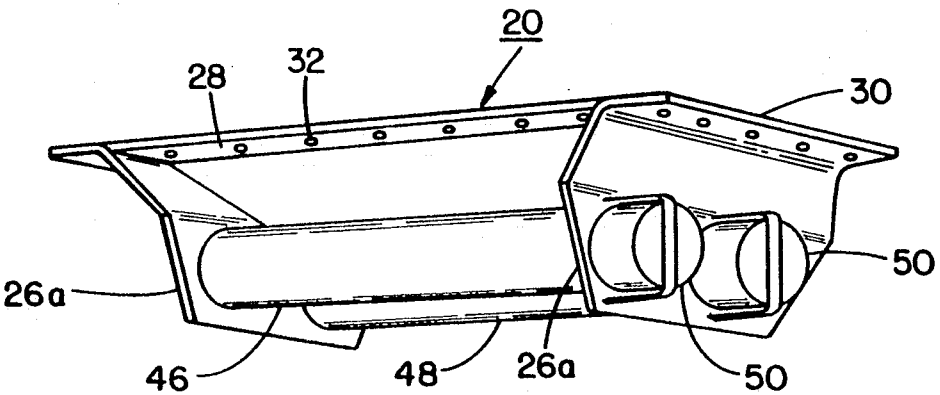
FIG. 2 illustrates a perspective view of the inventive pneumatic outlet or unloading apparatus.
Figure 3:
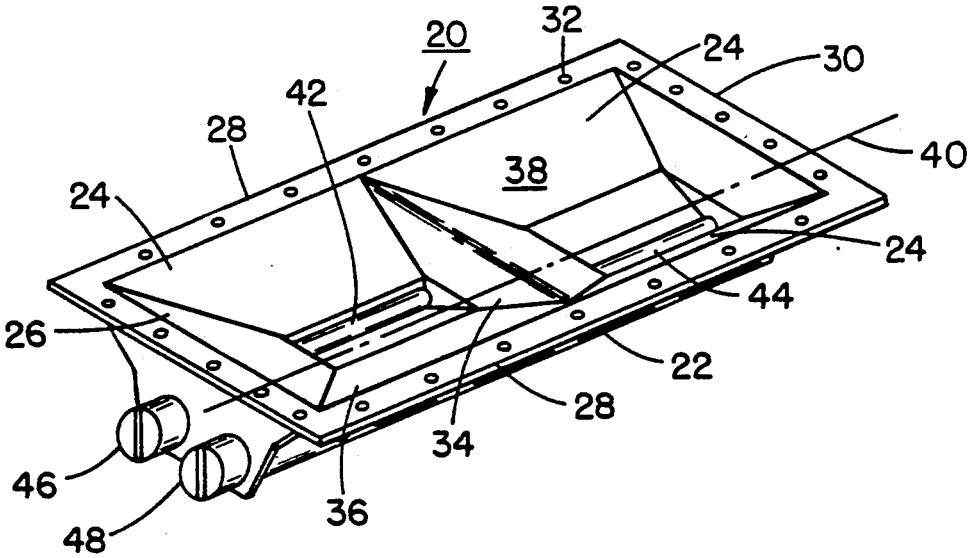
FIG. 3 illustrates a top perspective view of the pneumatic outlet apparatus.
Figure 4:
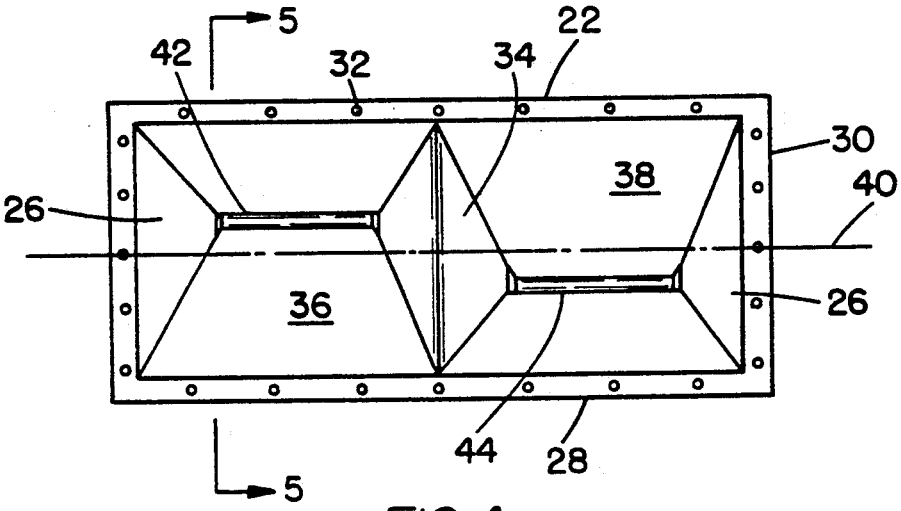
FIG. 4 illustrates a top plan view of the pneumatic outlet apparatus.
Figure 7:
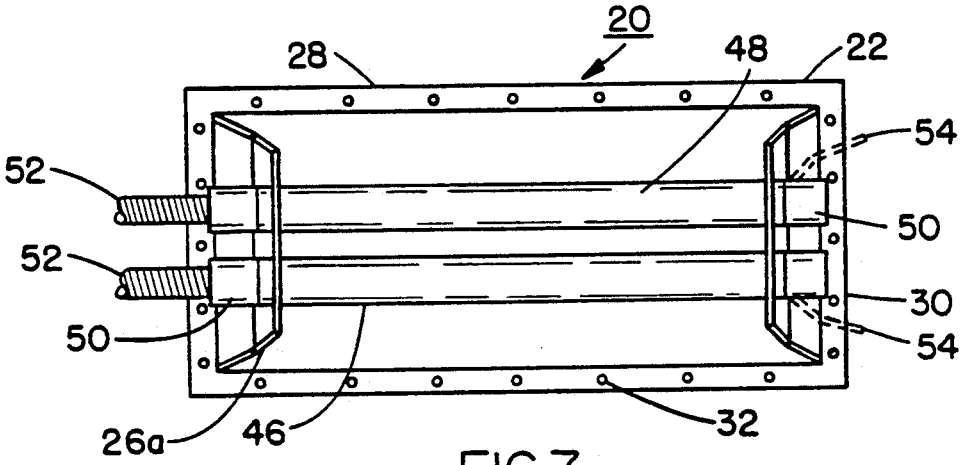
FIG. 7 illustrates a bottom plan view of the pneumatic outlet apparatus.
Figure 5:
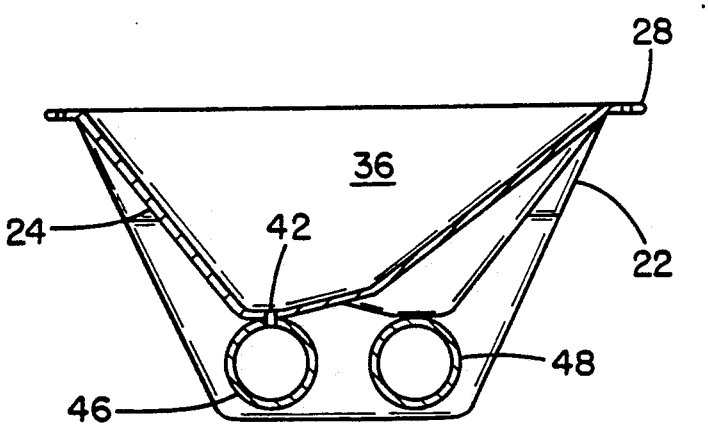
FIG. 5 illustrates a sectional view taken along line V—V in FIG. 4.
Figure 6:
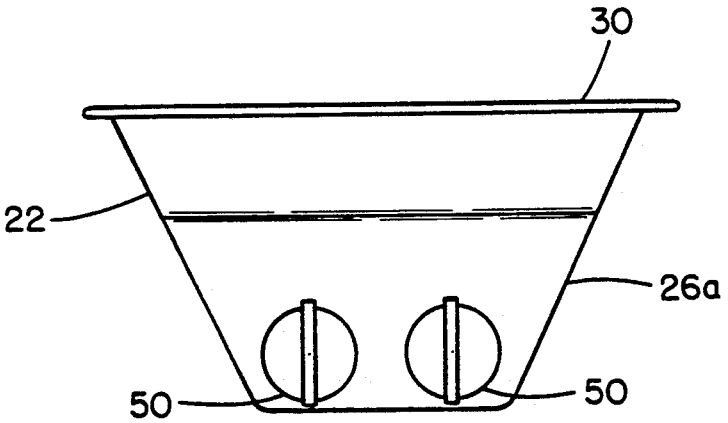
FIG. 6 illustrates an end view of the pneumatic outlet apparatus.

Referring now in more extensive particularity to the drawings, and especially FIG. 1, there is illustrated, in a partial section, an elevational side view of a rail car 10 having a plurality of compartments 12 each extending across the full width of the rail car 10, with each compartment 12 having openings with hatch covers 14 at the top thereof for the inlet of a quantity of a flowable bulk material adapted to fill the applicable rail car compartment 12. The lower end portion of each compartment is provided with a bottom hopper 16 of generally a downwardly reducing or narrowing cone-like cross-section, such as an inverted pyramid, and each of which includes a rectangular horizontal bottom flange 18 for the attachment of an outlet device or apparatus 20, generally of the pneumatic type, for the controlled discharge of the bulk material which is contained in each compartment 12. The structure described hereinabove is essentially conventional in nature and widely employed in industry with regard to hopper-type rail cars which are adapted for the transport of basically dry, flowable bulk materials of diverse types of powder or granular consistency, such as grains, cereals, plastic pallets, flour, sugar, salt, shelled peanuts and numerous other kinds of commodities.

The inventive pneumatic outlet apparatus 20 for the controlled discharge of the flowable bulk product from the compartment 12, in this instance, shelled whole peanuts or the like; referring to FIGS. 2 through 7 of the drawings, consists of a trough member 22 having a downwardly converging side wall structure 24 and converging end walls 26. The length of the outlet apparatus 20 essentially corresponds to the full width of the rail car 10, and encompassing flanges 28 and 30 at the upper ends of walls 24 and 26 incorporate suitable holes 32 adapted to align with holes formed in the flange 18 at the lower or discharge end of the hopper 16, so as to enable to be fastened thereto through the intermediary of suitable locking bolts or screws (not shown).

The outlet apparatus 20 is also provided with a central partition having downwardly diverging walls 34 so as to divide the trough member 22 of the outlet apparatus 20 into a first downwardly narrowing compartment 36 and a second downwardly narrowing compartment 38 along the length thereof. The walls 24, 26 and 34 sloped such that the bottom ends or lower apices the compartments 36 and 38 are offset relative to each on opposite sides of an imaginary longitudinal centerline 40 of the trough member 22 of the outlet apparatus 20.

At the bottom of each compartment 36 and 38 there is respectively provided a longitudinally extending slot-like discharge orifice 42 and 44, which are also offset relative to each other on opposite sides of the longitudinal centerline 40, and are arranged to extend in a parallel relationship. In essence, each compartment 36 and 38 has a downwardly narrowing, inverted pyramid configuration, the lower apex (at the bottom thereof) of each having the respective elongate or slot-like discharge orifice 42, 44 formed therein.

Extending below each of the discharge orifices 42 and 44, coaxial with the longitudinal extent thereof in the direction of the centerline 40, are a pair of parallel spaced conduits or pipes 46 and 48 each of which has, respectively, an upper slotted opening communicating with the associated discharge orifice 42 and 44. The parallel extending pipes or conduits, at the opposite ends thereof extend through flange-like plate extensions 26*a* of the end plates 26 below the bottom ends of the trough-shaped compartments 36, 38, with the plate extensions 26 forming a mounting structure for the pipes or conduits 46, 48. The entire structure of the outlet apparatus 20 integrally joined through suitable welding, and is preferably constituted from a corrosion-resistant metal, such as stainless steel or the like, which would not lead to any contamination of the bulk material stored in the compartments 12 of the rail car 10.

The opposite ends of each of the conduits 46, 48 may be equipped with openable and reclosable closure caps 50 so as to enable selective attachment to the conduit of a hose 52 at either end thereof, communicating with a suitable vacuum-generating arrangement (not shown) which will aspirate or suction the bulk material contained in the respective compartment 12 of the rail car 10 when it is desired to discharge the material through the bottom 16 hopper and outlet apparatus 20.

Although the invention contemplates a valveless operation; in effect, the bulk material may simply fall into conduits 46, 48 through orifices 42, 44 from the compartments 36, 38 under the action of gravity, and discharged from the conduits by opening the applicable end caps 52 and applying a vacuum, each of the conduits or pipes 46, 48 may be optionally equipped with appropriate valving devices for selectively opening and closing the hopper discharge orifices 42, 44, as is well-known in the technology. For example, such valves are available from the Youngstown Steel Door Company under the designation Double Groove II vacuum-pneumatic outlets for hopper rail cars, or possibly a rotary control valve for a bottom discharge outlet such as is disclosed in U.S. Pat. No. 4,114,785, assigned to ACF Industries, Inc., New York, N.Y. For purposes of clarity, such rotary valves are not disclosed in detail herein, only the external actuating handles thereof being illustrated and identified by reference numeral 54.

When it is desired to discharge the bulk material contents stored in a particular compartment 12 of the hopper rail car 10, then one of the end caps 50 of each of the pipes or conduits 46 and 48 is swung open, and a suitable pneumatic hose 52 coupled to the conduit, preferably through threaded engagement with a thread provided at the ends of each conduit. Either end of the pipes or conduits 46, 48 may be opened and connected to a hose 52, depending upon the side of the rail car 10 at which it is desired to effect the discharge of the bulk material.

Thereafter, in the optional embodiment employing valves, the valve in the respective conduit 46 and/or 48 is opened through the suitable actuation of the handle 54 associated with the end of the conduit 46, 48 having the hose 52 coupled thereto, causing the opening in the rotary valve arranged within the applicable conduit to be in alignment with the discharge orifice 42 or 44 of the respective hopper compartment 36 and 38, and a vacuum is applied to the bottom hopper 16 and lower end of the compartment 12 by means of a suitable vacuum-pneumatic apparatus (not shown) through the coupled hose 52. This controlled discharge of the flowable bulk material through the respective slot-like discharge orifices 42 and 44 into the parallel-extending linear pipes or conduits 46, 48 will facilitate the controlled discharging of the material from compartment 12 without having the latter flow through any considerable bends in piping or circuitous flow paths, this reducing the potential of any damage being encountered by the bulk material, especially when the latter is of a fragile nature such as shelled whole peanuts, or similar type of commodity.

The communication between the openings in the respective conduits 46 and 48 and the slot-like discharge orifices 42 and 44 in the bottoms of the trough compartments 36, 38, allow for a smooth and controlled balanced discharge of the shelled peanuts or other bulk material from the regions of the rail car compartment 12 across the full width thereof into the two parallel extending conduits 46 and 48. This results in a smoothly flowing discharge of the bulk material from the compartment 12 through the hopper 16 and the pneumatic outlet apparatus 20 into the conduits 46 and 48 and, resultingly, through the hoses 52 which connected to the opened discharging ends of the respective conduits 46 or 48.

From the foregoing, it becomes readily apparent to one skilled in the art that the pneumatic hopper outlet apparatus allows for a smooth and simplified discharge of the contents of the rail car compartment and hopper, thereby considerably reducing the danger of any damage being encountered by bulk material of a fragile and easily damaged nature being discharged, with the result of reducing potentially extensive economic losses to the owner and/or shipper of the bulk materials or commodities.

While there has been shown and described what is considered to be a preferred embodiment of the invention, it will of course be understood that various modifications and changes in form or detail could readily be made without departing from the spirit of the invention. It is therefore intended that the invention be not limited to the exact form and detail herein shown and described, nor to anything less than the whole of the invention herein disclosed as hereinafter claimed.

What is claimed is:

1. A pneumatic unloading apparatus for the discharge of a flowable bulk material from the bottom of a hopper; a trough-shaped housing connected to the lower end of said hopper, said housing having downwardly converging side walls and end walls, and a partition wall spaced between said end walls for separating said housing into a plurality of longitudinally spaced downwardly narrowing compartments; elongate slot-like orifices formed in the bottom of each said compartment, said orifices extending in parallel and being offset relative to each other at opposite sides of a longitudinal centerline extending through said housing, first and second parallel arranged conduits extending below said compartments on opposite sides of and coextensive with said longitudinal centerline, each said conduit having an opening means communicating with the respective orifice of the compartment on the same side of said centerline; and means for imparting a vacuum to each said conduit for aspirating bulk material from said hopper through the compartment and orifice associated therewith.

2. A pneumatic unloading apparatus as claimed in claim 1, each said conduit including means for applying the vacuum to selectively the opposite ends thereof.

3. A pneumatic unloading apparatus as claimed in claim 1, comprising valve means associated with each said conduit for selectively opening and closing the opening in the conduit communicating with the orifice of the compartment associated with said conduit.

4. A pneumatic unloading apparatus as claimed in claim 1, wherein said compartments in said housing are spaced transversely across the width of a hopper rail car.

5. A pneumatic unloading apparatus as claimed in claim 4, wherein a vacuum is selectively appliable to said conduits from either side of said hopper rail car.

6. A pneumatic unloading apparatus as claimed in claim 1, wherein each of said conduits includes openable closure caps at the opposite ends thereof, said caps being selectively opened to facilitate connection of a vacuum source to said opened end of the conduit for suctioning bulk material therethrough from said hopper.

* * * * *